United States Patent [19]

Locke et al.

[11] Patent Number: 4,473,446

[45] Date of Patent: Sep. 25, 1984

[54] CHROMIC ACID-FLUORIDE ANODIZING SURFACE TREATMENT FOR TITANIUM

[75] Inventors: Melvin C. Locke; Joseph A. Marceau; Kevin M. Harriman, all of Seattle, Wash.

[73] Assignee: The Boeing Company, Seattle, Wash.

[21] Appl. No.: 456,265

[22] Filed: Jan. 6, 1983

Related U.S. Application Data

[63] Continuation of Ser. No. 259,374, May 1, 1981.

[51] Int. Cl.[3] ..... C25D 11/02; C25D 11/34

[52] U.S. Cl. ..... 204/32.1; 204/56 R; 204/38 A

[58] Field of Search ..... 204/32 R, 56 R, 38 A

[56] References Cited

U.S. PATENT DOCUMENTS 3,959,091 5/1976 Moji et al. ..... 204/38 A

*Primary Examiner*—R. L. Andrews

*Attorney, Agent, or Firm*—Christensen O'Connor, Johnson & Kindness

[57] ABSTRACT

A method for surface treating titanium articles prior to adhesive bonding by anodization in a chromic-hydrofluoric acid bath at a low anodizing potential of greater than one volt but less than five volts.

12 Claims, No Drawings

CHROMIC ACID-FLUORIDE ANODIZING SURFACE TREATMENT FOR TITANIUM

This is a continuation of the prior application Ser. No. 259,374, filed May 1, 1981, the benefit of the filing dates of which are hereby claimed under 35 USC 120.

BACKGROUND OF THE INVENTION

Adhesively bonded titanium structural components have been used in aircraft applications for many years. Service experience with these bonded structures has been varied with frequent failures from debonding of titanium articles. The bonding failures can be attributed to the different interfacial structures of the variously treated adherends. Numerous titanium surface treatments have been developed and used to promote adhesion and reduce the number of bonding failures. Among these are the method of anodizing titanium to promote adhesion disclosed in the U.S. Pat. No. 3,959,091, issued to Y. Moji and J. A. Marceau. Although the latter treatment significantly increases the bond performance of titanium articles, under certain conditions an apparent brittle oxide failure weakness still occurs near or at the metal oxide primer interface.

It is therefore an object of the present invention to eliminate this apparent brittle oxide failure weakness while maintaining the bonding strength of titanium articles at or equal to that achieved by the method disclosed in the aforementioned patent.

SUMMARY OF THE INVENTION

In accordance with the foregoing objects and other objects that will become apparent to one of ordinary skill in the art after reading the ensuing specification, the present invention provides a process for forming a porous adhesion-promoting oxide coating on a titanium article by anodizing the article at a relatively low anodization potential. Prior to anodization the surface of the titanium article can be etched with a relatively mild alkaline etching solution maintained at a temperature of from about 160° F. to about 220° F. The titanium article is immersed in the solution for a period of at least about 15 minutes and preferably from about 18 to about 20 minutes. Alternatively, the titanium article can be immersed first in a mild alkaline cleaning solution followed by an acid pickle in a conventional nitric acid-hydrofluoric acid pickling bath.

Thereafter, the article is removed from the alkaline etching solution or pickling bath, water rinsed, and anodized in an aqueous solution comprising fluoride ions and an oxidizing electrolyte. The pH of the anodizing solution is maintained at less than about 6.0 while the temperature of the solution is maintained at at least about 50° F., and preferably from 60° F. to 70° F. The anodizing potential is maintained at greater than one volt and less than five volts. The fluoride ion concentration is maintained at a level that results in a current density of from about 0.5 to about 3.0 amperes per square foot. The article is anodized for at least five minutes and preferably from 20 to 22 minutes. Once the anodizing step has been completed, the article is removed from the anodizing solution, rinsed with water, and dried. It is important that the article be rinsed with water within about two minutes from the cessation of anodizing current.

DETAILED DESCRIPTION OF THE INVENTION

The process of the present invention will produce titanium oxide coatings on titanium articles that, when incorporated into an adhesively bonded system, provide environmentally stable bonds superior to those obtained with otherwise identical systems in which the titanium coating was produced by other methods. The process of the present invention varies from the prior processes, especially that disclosed in the aforementioned patent issued to Moji and Marceau, in that the anodizing potential is maintained well below those levels heretofore thought necessary. Additionally, the titanium article can be subjected to an alkaline etching step in a relatively mild alkaline etching solution prior to anodization. Alternatively, or additionally if desired, the titanium article can also be subjected to an acid pickling step prior to anodization.

Wedge, peel, and lap shear tests conducted in accordance with standard methods show no, or only a very small amount of, oxide-metal interfacial failure when the conditions of the present invention are observed. The oxide characteristics produced by the low-voltage anodization produce oxide coatings that are uniformly porous and have a columnar structure. This oxide is very receptive to polymeric adhesive materials. Furthermore, the process of the present invention is relatively simple to practice in a production situation and does not require etching with a strong alkaline solution maintained at high temperatures.

Titanium articles to be anodized in accordance with the present invention include titanium alloys, such as the alloy Ti-6Al-4V. The titanium articles are preferably precleaned with a conventional vapor degreaser or solvent cleaner. This precleaning step removes the oil and other water-insoluble materials from the titanium surface prior to an alkaline cleaning step.

After precleaning, the article is subjected to a mild alkaline etch at moderate temperatures. A suitable, commercially available, alkaline etching solution that can be utilized in accordance with the present invention is sold under the trade name "Kelite 235" and is manufactured by Allied-Kelite Product Division, The Richardson Company, Des Plains, Ill. It is preferred that the alkaline etchant be mixed with water to produce a mild alkaline solution having a pH preferably in the range of 9.0 to 10.0. The Kelite 235 solution can, for example, be mixed with water in amounts ranging from 10 to 15 ounces per gallon of water to produce the desired etching solution. During the cleaning step, the alkaline solution is maintained at a temperature ranging from 160° to 220° F., but preferably in the range of 160° to 180° F., making the solution much easier to handle than prior art processes that have required very strong alkaline etching solutions to be maintained at higher temperatures. The titanium article is immersed in the alkaline etching solution for at least about 15 minutes and preferably from 18 to 20 minutes. When the etching step is finished, the titanium article is removed and rinsed with hot water for about five to about eight minutes.

If the titanium article has been subjected to heat treatment or forming processes, scales sometime build up on the article. These scales must be removed prior to bonding by subjecting the titanium article to an acid pickling step in a nitric acid-hydrofluoric acid pickling bath. Prior to pickling, the titanium article is preferably first immersed in a conventional alkaline cleaning solution of sufficient high concentration and temperature to produce mild etch of the titanium. The alkaline cleaning sol·tion is preferably of the phospho-silicate type. A typical alkaline cleaner will contain about 30% sodium metasilicate, about 35% caustic soda, about 9% soda ash with the balance being sodium tripolyphosphate. This pickling step is conventional and is disclosed, for example, in the patent referenced above. Once the acid pickling step is completed, the titanium article is again rinsed with water.

Thereafter, the titanium article is anodized in accordance with the present invention. The anodizing bath generally comprises an aqueous solution of fluoride ions and an oxidizing electrolyte. The basic composition of the anodizing solution is known in the art and disclosed in the above-referenced patent. A typical and preferred bath comprises chromic acid and hydrofluoric acid. The anodization is conducted at temperatures from 50° to about 80° F., but preferably in the range of from 60° F. to 70° F. The anodizing bath preferably contains about 5% chromic acid, although this concentration of chromic acid is not critical. The fluoride ion concentration is adjusted to result in a current density ranging from 0.5 amperes per square foot to about 3 amperes per square foot, but preferably from about 0.75 to 1.75 amperes per square foot. The solution is continuously agitated. The anodizing potential is maintained in accordance with the present invention at greater than one volt and less than five volts, preferably from three volts to less than five volts, and most preferably from about 3.5 volts to about 4.5 volts. The anodization step is conducted for at least about 5 minutes and preferably from about 20 to 22 minutes.

Once the anodization step is completed, the anodizing current is turned off and the titanium article removed from the anodizing bath. The article is then rinsed with cold water for at least about five minutes and therafter hot air dried at a temperature from 140° to 160° F., for example. It is very important that the article be rinsed within about two minutes after the cessation of the anodizing current to prevent destruction of the oxide coating by the anodizing solution. Once the titanium article is dried, it is preferred that it be primed within about 72 hours. A suitable polymeric primer is sold under the trade name "BR-127" by the American Cyanamid Company. Thereafter, the articles can be bonded to similarly preconditioned articles or other articles with conventionally available polymeric adhesives such as those sold under the trade names "FM-73" and "FM-300" by the American Cyanamid Company.

EXAMPLE

The surface treatment of the present invention was experimentally conducted upon several sample articles. The articles were composed of a titanium alloy (Ti-6Al-4V) produced in accordance with MIL-T-9046. The test specimens were surface treated in accordance with the present invention by first vapor degreasing, thereafter subjecting to a mild alkaline etch with Kelite-235. No acid pickle was employed. The articles were anodized immediately after being removed from the alkaline etch bath and water rinsed. All process conditions were maintained within the preferred ranges in accordance with the present invention unless otherwise noted. After the articles were dried, they were primed, coated with an adhesive, and joined to similarly prepared articles. The adhesive was then cured. The adhesive employed was FM-73 while the primer was BR-127. An adhesive cure cycle of 90 minutes at 250° F. and 50 psi was employed. Conventional peel tests were conducted on various specimens in accordance with the conditions set forth in the accompanying Tables I and II. The peel tests were conducted in accordance with ASTM D1781.

Results of peel tests conducted on specimens anodized at various voltages from one volt to six volts are set forth in Table I. The current density was maintained at one amp/square foot while the solution is agitated. Constant current density was achieved by the addition of fluoride ions. It is clear that at voltage ranging from two to about five volts a desirable cohesive failure mode was obtained while at less than two volts and greater than five volts, undesirable adhesive failure developed. At less than two volts, adhesive failure occurred at the primer-oxide interface probably due to thin oxide or improperly developed oxide. At greater than five volts, adhesive failure occurred within oxide due to apparent brittle oxide.

Table II sets forth similar results for peel tests conducted on specimens that were anodized for twelve minutes. It is seen that again cohesive failure is achieved at anodization voltages of about two to four volts, while the adhesive failure begins to develop within the oxide (due to brittle oxide) at anodization voltages of five volts. Wedge and lap shear tests also conducted on the specimens indicated that the bonds formed between titanium articles when pretreated in accordance with the present invention were as strong or stronger than those pretreated by prior art methods such as that of the aforementioned patent.

The foregoing invention has been disclosed in conjunction with a preferred embodiment and variations thereof. Various changes and substitutions of equivalents can be effected by one of ordinary skill in the art after reading the foregoing specification without departing from the general concepts disclosed herein. It is therefore intended that the scope of Letters Patent granted hereon be limited only by the definition contained in the appended claims and equivalents thereof.

TABLE I

PEEL TEST
Voltage Variation
(1.0 Amp/ft$^2$)

| Voltage | R.T. lb/in | Failure Mode | Ave. lb/in |
|---|---|---|---|
| 1 volt | 16 | Adhesive | 17.4 |
| | 16 | Adhesive | |
| | 16 | Adhesive | |
| | 23 | Adhesive | |
| | 16 | Adhesive | |
| 2 volts | 37 | Cohesive | 34.2 |
| | 33 | Cohesive | |
| | 31 | Cohesive | |
| | 36 | Cohesive | |
| | 34 | Cohesive | |
| 3 volts | 37 | Cohesive | 35.0 |
| | 33 | Cohesive | |
| | 35 | Cohesive | |
| | 33 | Cohesive | |
| | 37 | Cohesive | |
| 4 volts | 34 | Cohesive | 33.2 |
| | 30 | Cohesive | |
| | 36 | Cohesive | |
| | 34 | Cohesive | |
| | 32 | Cohesive | |
| 5 volts | 33 | Cohesive | 33.0 |
| | 31 | Cohesive | |
| | 36 | Cohesive | |
| | 32 | Cohesive | |
| | 33 | Cohesive | |

TABLE I-continued

| Voltage | PEEL TEST Voltage Variation (1.0 Amp/ft$^2$) R.T. lb/in | Failure Mode | Ave. lb/in |
|---|---|---|---|
| 6 volts | 13 | Adhesive | 13.0 |
| | 12 | Adhesive | |
| | 13 | Adhesive | |
| | 13 | Adhesive | |
| | 14 | Adhesive | |

TABLE II

| Voltage | PEEL TEST Voltage Variation (1.0 Amp/ft$^2$) (Anodized 12 min) R.T. lb/in | Failure Mode | Ave. lb/in |
|---|---|---|---|
| 2 volts | 37 | Cohesive | 34.2 |
| | 33 | Cohesive | |
| | 31 | Cohesive | |
| | 36 | Cohesive | |
| | 34 | Cohesive | |
| 3 volts | 32 | Cohesive | 33.8 |
| | 33 | Cohesive | |
| | 35 | Cohesive | |
| | 33 | Cohesive | |
| | 36 | Cohesive | |
| 4 volts | 36 | Cohesive | 33.6 |
| | 33 | Cohesive | |
| | 35 | Cohesive | |
| | 29 | Cohesive | |
| | 35 | Cohesive | |
| 5 volts | 35 | Cohesive | 31.8 |
| | 16 | 40% Cohesive | |
| | 38 | 98% Cohesive | |
| | 35 | Cohesive | |
| | 35 | 95% Cohesive | |

The embodiments of the invention in which an exclusive property or privilege is claimed are defined as follows:

1. A method of forming a porous adhesion-promoting oxide coating on a titanium article comprising the steps of:

anodizing said titanium article in an aqueous anodizing solution comprising fluoride ions and an oxidizing electrolyte for at least five minutes, the anodizing temperature of said solution being at least about 50° F., the fluoride ion concentration of said solution being such as to result in a current density of from about 0.5 amperes per square foot to about 3/0 amperes per square foot, the anodizing potential of said solution ranging from greater than one volt to less than five volts, and rinsing said aqueous anodizing solution from said article with water.

2. The process of claim 1 wherein said anodizing solution is rinsed from said article within two minutes after the cessation of the anodizing current.

3. The method of claim 1 wherein said anodizing potential ranges from about three volts to less than five volts.

4. The method of claim 3 wherein said anodizing potential ranges from 3.5 volts to 4.5 volts.

5. The method of claim 1 wherein said anodizing temperature ranges from about 50° F. to about 80° F.

6. The process of claim 5 wherein said anodizing temperature of said anodizing solution ranges from about 60° F. to about 70° F.

7. The method of claim 1 further comprising the step of:

immersing said titanium article in an acid pickling bath prior to anodizing said article.

8. The method of claim 1 wherein said anodizing solution comprises a solution of chromic acid and hydrofluoric acid having a pH of less than about 6.0.

9. The method of claim 1 further comprising:

prior to anodizing said article, immersing said article in a mild alkaline etching solution maintained at a temperature of about 160° F. to about 220° F. for a period of at least about fifteen minutes, and thereaftet rinsing said etching solution from said article with water.

10. The method of claim 9 wherein said alkaline etching solution is maintained at a temperature of from 160° to about 180° .

11. The method of claim 1 wherein said current density ranges from about 0.75 to 1.75 amperes per square foot.

12. The method of claim 1 wherein said titanium article is anodized for a period of from twenty to twenty-two minutes.

* * * * *

UNITED STATES PATENT AND TRADEMARK OFFICE

CERTIFICATE OF CORRECTION

PATENT NO. : 4,473,446

DATED : September 25, 1984

INVENTOR(S) : Melvin C. Locke et al.

It is certified that error appears in the above-identified patent and that said Letters Patent is hereby corrected as shown below:

| | |
|---|---|
| Column 3, line 37: | "therafter" should be --thereafter--. |
| Column 6, line 4: | "3/0" should be --3.0--. |
| Column 6, lines 34 & 35: | "thereaftet" should be --thereafter--. |

Signed and Sealed this

*Fifth* Day of *March 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,473,446

DATED : September 25, 1984

INVENTOR(S) : Melvin C. Locke et al.

It is certified that error appears in the above-identified patent and that said Letters Patent is hereby corrected as shown below: Item [75]:

Title Page, under "Inventors", add --Yukimori Moji--.

Signed and Sealed this

*Fourteenth* Day of *May 1985*

[SEAL]

*Attest:*

DONALD J. QUIGG

*Attesting Officer* *Acting Commissioner of Patents and Trademarks*